US005974754A

United States Patent [19]

Bodine et al.

[11] Patent Number: 5,974,754

[45] Date of Patent: Nov. 2, 1999

[54] CEILING BOARD CORNER EMBOSSING

[75] Inventors: Darryl C. Bodine, Lancaster; G. Douglas Vernau, Mountville, both of Pa.

[73] Assignee: Armstrong World Industries, Inc., Lancaster, Pa.

[21] Appl. No.: 08/297,122

[22] Filed: Aug. 29, 1994

[51] Int. Cl.[6] ..... E04B 9/00

[52] U.S. Cl. ..... 52/506.08; 52/506.06

[58] Field of Search ..... 52/506.06, 506.07, 52/506.08, 789.1, 798.1

[56] References Cited

U.S. PATENT DOCUMENTS

| | | | |
|---|---|---|---|
| 1,474,295 | 2/1923 | Goldsmith | 52/323 |
| 3,153,304 | 10/1964 | Evangelista | 52/506.07 X |
| 3,378,976 | 4/1968 | Meredith, Jr. | 52/506.07 |
| 3,425,179 | 2/1969 | Haroldson | 52/263 X |
| 3,568,390 | 3/1971 | Swensen et al. | 52/789.1 |
| 4,621,468 | 11/1986 | Likozar | 52/263 X |
| 4,769,965 | 9/1988 | Shaub | 52/506.07 |
| 4,835,924 | 6/1989 | Blacklin et al. | 52/263 |
| 4,885,889 | 12/1989 | Hemphill et al. | 52/506.06 |
| 4,901,485 | 2/1990 | Menchetti et al. | 52/506.08 X |
| 5,072,557 | 12/1991 | Naka et al. | 52/263 X |
| 5,121,576 | 6/1992 | Wu | 52/309.1 |

FOREIGN PATENT DOCUMENTS

| | | | |
|---|---|---|---|
| 555365 | 4/1958 | Canada | 52/506.06 |
| 854940 | 11/1970 | Canada | 52/263 |
| 3114590 | 10/1982 | Germany | 52/126.6 |
| 1266963 | 3/1972 | United Kingdom | 52/126.6 |

*Primary Examiner*—Carl D. Friedman
*Assistant Examiner*—Laura A. Callo

[57] ABSTRACT

A ceiling board has a depression formed in the four corners of the face surface of the ceiling board. When the horizontal flange of one cross runner overlies the horizontal flange of the main runner, the edge of the ceiling board will rest on the flange of the main runner because the overlying runner is accommodated in the corner depression.

2 Claims, 1 Drawing Sheet

CEILING BOARD CORNER EMBOSSING

BACKGROUND OF THE INVENTION

1. Field of the Invention

The invention is directed to a ceiling board and, more particularly, a ceiling board with corner embossing.

2. Description of the Prior Art

Normally a ceiling board is installed in a metal grid system wherein the four corners and four edges of the ceiling board are supported on the flanges of the grid system. In some grid systems, the flange of the right angle cross runner runs up on the flange of the main runner as shown in U.S. Pat. Nos. 3,093,221 and 4,611,453.

The presence of one flange overlying the other flange raises the corners of the ceiling board supported thereon. This, in turn, spaces the edge of the ceiling board between the two adjacent raised corners a slight distance above the flange therebetween. A dark shadow effect or gap is created that detracts from the overall appearance of the ceiling system.

The embossed corner feature herein permits the overlying flange to be accommodated in the embossed area and the edge of the ceiling board to rest on the adjacent flange.

SUMMARY OF THE INVENTION

A conventional ceiling board has an embossed depression placed in the four corners of the face of the ceiling board. The depression is normally square in shape and the size of one-half the total width of a runner flange. When the ceiling board is placed on the grid system with an overlying flange, the overlying flange lies in the depression and the edges of the ceiling board rest directly on the underlying adjacent flange.

DESCRIPTION OF THE PREFERRED EMBODIMENTS

Figure 1:
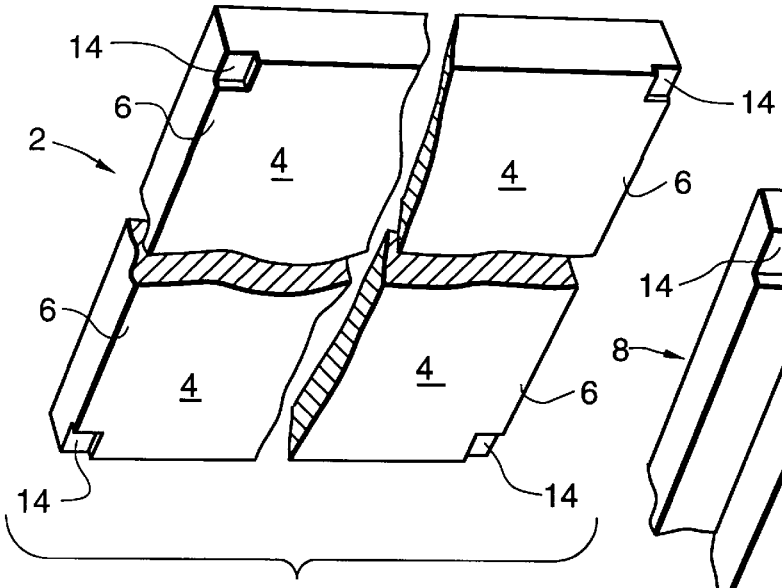
FIG. 1 is one form of a ceiling board with an embossed depression.
Figure 2:
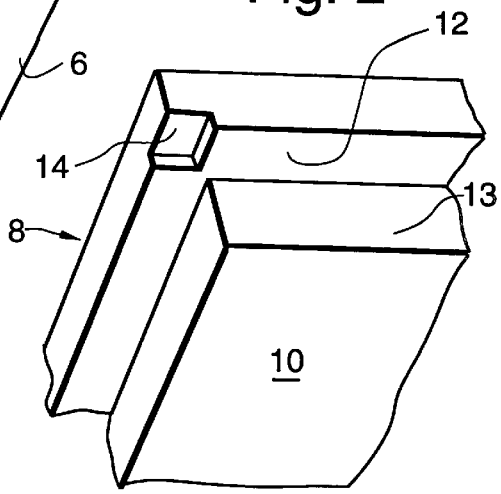
FIG. 2 is another form of a ceiling board with an embossed depression.

The flat ceiling board 2 of FIG. 1 has a face surface 4, an edge 6 and a depressed corner area 14. The edge 6 rests on the flange of a ceiling runner. The tegular ceiling board 8 of FIG. 2 has a face surface 10, an edge 12 and a depressed corner area 14. The edge 12 rests on the flange of a ceiling runner and element 13 extends below the runner flange.

Figure 3:
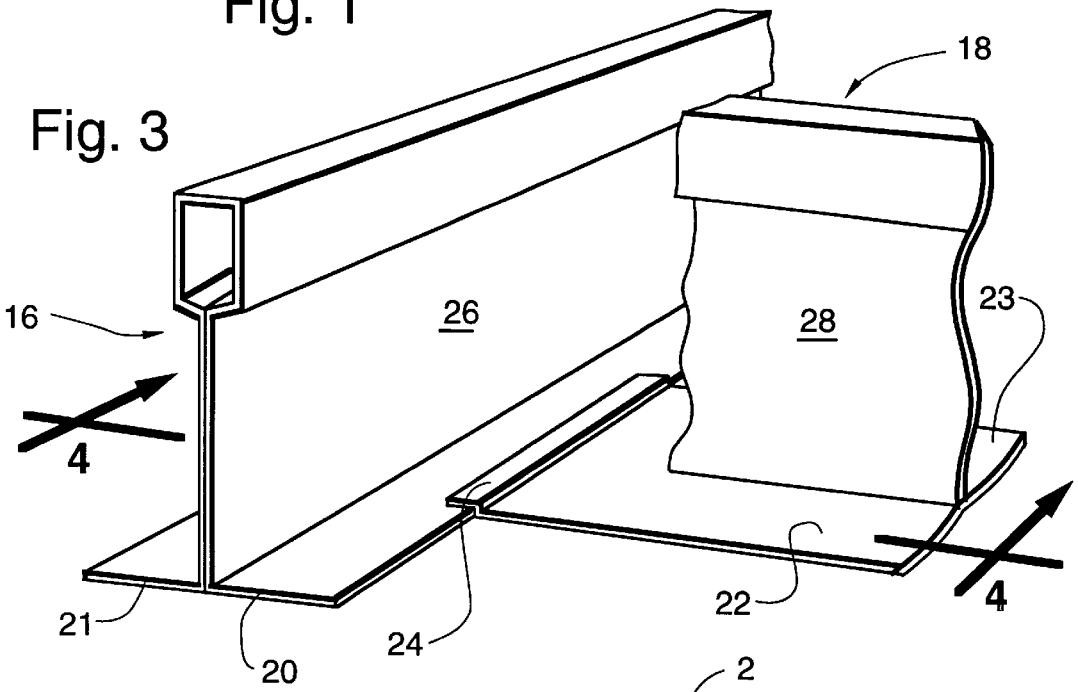
FIG. 3 is a showing of an overlying flange grid structure.

FIG. 3 shows part of a grid system with a main runner 16 and cross runner 18. Main runner 16 has a web 26 with flanges 20 and 21 extending on either side thereof to support the edges of a ceiling board. Cross runner 18 has a web 28 with flanges 22 and 23 extending on either side thereof to support a ceiling board. Flanges 20 and 22 will support two adjacent edges of the same ceiling board. Element 24 of cross runner 18 overlies flange 20 of main runner 16.

Figure 4:
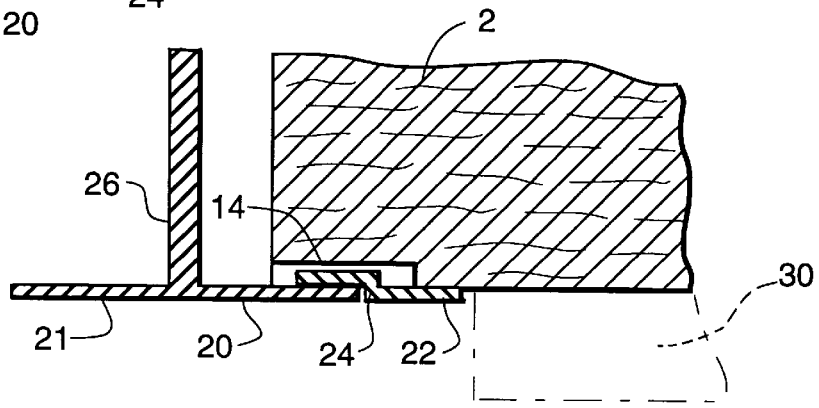
FIG. 4 is a cross-section of FIG. 3 along line 4—4 with the overlying flange shown lying in the embossed depression.

FIG. 4 is a cross-sectional view along line 4—4 of FIG. 3 with the addition of a ceiling board 2 in solid lines being placed in position on flanges 20 and 22. The dotted line 30 shows that element 13 of FIG. 2 extends below the flanges to form the tegular design feature. It is edges 6 of FIG. 1 and edges 12 of FIG. 2 that rest on the flanges to support the ceiling board. It can be seen that element 24, which overlies flange 20, is in depression 14 and the edges of the ceiling board rest on the flanges.

The depression 14 can be cut or embossed in the corners of the ceiling board. The depression is sized to accommodate the height and width of the overlying flange. If the adjacent flanges are placed in an abutting position (no overlying of one flange over the other adjacent flange), the depression is not needed and will be concealed by the flanges.

What is claimed is:

1. A ceiling system comprising:

(a) a ceiling board and a ceiling grid system;

(b) said ceiling board having a face surface with four corners and four support edge means in a plane surrounding the face surface;

(c) a depressed area being placed only in the support edge means only at each of the four corners thereof to form a depressed corner area above the plane of the support edge means;

(d) said ceiling grid system having plural board support means in a rectangular plane with slight raised areas at points where board support means intersect; and (e) said depressed corner area being a mean for receiving the slight raised areas of the board support means to permit the plane of the board support edge means of the board to be in the rectangular plane of the board support means of the ceiling grid system to remove the gap that otherwise would exist between the board edge support means and the ceiling grid system board support means in the area between the slight raised areas of the ceiling grid system.

2. A ceiling system as set forth in claim 1 wherein the ceiling board has a tegular edge design with the board face surface being in a separate plane from the plane of the support edge means.

* * * * *